US010406714B2

(12) United States Patent
Duerr et al.

(10) Patent No.: US 10,406,714 B2
(45) Date of Patent: Sep. 10, 2019

(54) POWER-TOOL CUTTING DEVICE

(71) Applicant: Robert Bosch GmbH, Stuttgart (DE)

(72) Inventors: Thomas Duerr, Asperg (DE); Petr Grulich, Kirchheim/Teck (DE)

(73) Assignee: Robert Bosch GmbH, Stuttgart (DE)

( * ) Notice: Subject to any disclaimer, the term of this patent is extended or adjusted under 35 U.S.C. 154(b) by 7 days.

(21) Appl. No.: 15/558,154

(22) PCT Filed: Mar. 1, 2016

(86) PCT No.: PCT/EP2016/054281

§ 371 (c)(1),
(2) Date: Sep. 13, 2017

(87) PCT Pub. No.: WO2016/188645

PCT Pub. Date: Dec. 1, 2016

(65) Prior Publication Data

US 2018/0079102 A1 Mar. 22, 2018

(30) Foreign Application Priority Data

May 22, 2015 (DE) ..... 10 2015 209 408

(51) Int. Cl.
*B27B 17/14* (2006.01)
*B27B 17/02* (2006.01)

(52) U.S. Cl.
CPC ..... *B27B 17/14* (2013.01); *B27B 17/02* (2013.01)

(58) Field of Classification Search
CPC ..... B27B 17/14; B27B 17/02
See application file for complete search history.

(56) References Cited

U.S. PATENT DOCUMENTS 2,532,981 A * 12/1950 Wolfe ..... B27B 17/02 267/182
3,636,995 A * 1/1972 Newman ..... B27B 17/14 30/386
5,345,686 A * 9/1994 Zimmermann ..... B27B 17/02 30/383

(Continued)

FOREIGN PATENT DOCUMENTS

DE 20 2006 002 709 U1 8/2007
DE 10 2012 215 461 A1 1/2014

(Continued)

OTHER PUBLICATIONS

International Search Report corresponding to PCT Application No. PCT/EP2016/054281, dated May 23, 2016 (German and English language document) (7 pages).

*Primary Examiner* — Hwei-Siu C Payer
(74) *Attorney, Agent, or Firm* — Maginot, Moore & Beck LLP

(57) ABSTRACT

A power-tool cutting device that is free of a torque-transmitting element includes at least one cutting strand and at least one guiding unit for guiding the cutting strand. The guiding unit together with the cutting strand forms a closed system. The power-tool cutting device has at least one preloading unit that is arranged on the guiding unit. The preloading unit is configured for automatic play compensation and/or tolerance compensation of the cutting strand at least during a state of the guiding unit in which the guiding unit is removed from a coupling device of a portable power tool.

8 Claims, 4 Drawing Sheets

(56) References Cited

U.S. PATENT DOCUMENTS

| | | | | |
|---|---|---|---|---|
| 7,287,330 | B1 * | 10/2007 | Riha | B27B 17/14 30/381 |
| 8,434,236 | B2 * | 5/2013 | Pellenc | B27B 17/14 30/381 |
| 9,381,666 | B1 * | 7/2016 | Moody | B27B 17/14 |
| 9,669,563 | B2 * | 6/2017 | Lee | B27B 17/14 |
| 9,701,037 | B2 * | 7/2017 | Zieger | B27B 17/02 |
| 9,724,841 | B2 * | 8/2017 | Engelfried | B27B 17/02 |
| 9,789,625 | B2 * | 10/2017 | Engelfried | B23D 57/023 |
| 2011/0314682 | A1 * | 12/2011 | Maag | B27B 17/14 30/386 |
| 2014/0106915 | A1 * | 4/2014 | Kistler | B27B 17/14 474/111 |
| 2018/0079102 | A1 * | 3/2018 | Duerr | B27B 17/14 |

FOREIGN PATENT DOCUMENTS

| | | |
|---|---|---|
| EP | 1 057 598 A2 | 12/2000 |
| GB | 806857 | 12/1958 |

* cited by examiner

POWER-TOOL CUTTING DEVICE

This application is a 35 U.S.C. § 371 National Stage Application of PCT/EP2016/054281, filed on Mar. 1, 2016, which claims the benefit of priority to Serial No. DE 10 2015 209 408.1, filed on May 22, 2015 in Germany, the disclosures of which are incorporated herein by reference in their entirety.

BACKGROUND

Already known from DE 10 2012 215 461 A1 is a power-tool parting device, which comprises at least one cutting strand, and at least one guide unit for guiding the cutting strand that, together with the cutting strand, constitutes a closed system. The known power-tool parting device is realized without a torque transmission element. Furthermore, the known power-tool parting device comprises at least one cutting-strand tensioning unit, which is disposed on the guide unit and is designed for compensating play and/or tolerance of the cutting strand.

SUMMARY

The disclosure is based on a power-tool parting device, which is realized without a torque transmission element, having at least one cutting strand, and having at least one guide unit for guiding the cutting strand that, together with the cutting strand, constitutes a closed system.

It is proposed that the power-tool parting device comprise at least one pretensioning unit, which is disposed on the guide unit and which is designed for automatically compensating play and/or tolerance of the cutting strand, at least when the guide unit is in a state of having been demounted from a coupling device of a portable power tool. "Realized without a torque transmission element" is to be understood here to mean, in particular, that the power-tool parting device is realized such that it is separate from a torque transmission element, in particular a toothed wheel. Particularly preferably, the power-tool parting device itself does not have a torque transmission element that is mounted on the guide unit and that engages in the cutting strand for the purpose of driving the cutting strand. Preferably, the power-tool parting device has a torque transmission element that, when the power-tool parting device, in particular the guide unit, is in a state of having been disposed on the coupling device of the portable power tool, engages in the cutting strand for the purpose of driving the cutting strand. The torque transmission element is preferably disposed on the coupling device of the portable power tool, in particular disposed in a rotatably mounted manner. The torque transmission element may be realized, in particular, as a toothed shaft of a transmission unit of the portable power tool. Particularly preferably, the torque transmission element may be realized as a toothed wheel, in particular as a pinion. The torque transmission element may likewise be realized as another component considered appropriate by persons skilled in the art. A "coupling device" is to be understood here to mean, in particular, a device designed to operatively connect the power-tool parting device to the portable power tool, by means of a form-fit and/or force-fit connection, for the purpose of performing work on a workpiece. In particular, when the coupling device is in a state of having been connected to the power-tool parting device and the portable power tool is in an operating state, forces and/or torques can be transmitted from the transmission unit of the portable power tool to the power-tool parting device, in particular by means of the torque transmission element of the portable power tool, for the purpose of driving the cutting strand. The coupling device is preferably realized as a tool receiver, in particular for receiving the power-tool parting device. Particularly preferably, the coupling device may be realized as a bayonet fixing, and/or as another coupling device considered appropriate by persons skilled in the art.

A "cutting strand" is to be understood here to mean, in particular, a unit designed to locally undo an atomic coherence of a workpiece on which work is to be performed, in particular by means of a mechanical parting-off and/or by means of a mechanical removal of material particles of the workpiece. Preferably, the cutting strand is designed to separate the workpiece into at least two parts that are physically separate from each other, and/or to part off and/or remove, at least partially, material particles of the workpiece, starting from a surface of the workpiece. Particularly preferably, in at least one operating state, the cutting strand is moved in a revolving manner, in particular along a circumferential direction of the guide unit of the power-tool parting device. Particularly preferably, the cutting strand is realized as a cutting chain. It is also conceivable, however, for the cutting strand to be of another design, considered appropriate by persons skilled in the art, such as, for example, designed as a cutting belt, on which a plurality of cutting-strand segments of the cutting strand are disposed. Preferably, the cutting-strand, as viewed along a direction that is at least substantially perpendicular to a cutting plane of the cutting strand, has a maximum dimension that is less than 4 mm. Preferably, the maximum dimension is realized as a cutting-strand thickness. Particularly preferably, the cutting strand, as viewed along the direction that is at least substantially perpendicular to the cutting plane of the cutting strand, has a maximum cutting-strand thickness that is at least substantially constant along a total length of the cutting strand. The maximum cutting-strand thickness, along the total length of the cutting strand, preferably corresponds to a value from a value range of from 1 mm to 3 mm. Consequently, the power-tool parting device, as viewed along a total extent of the power-tool parting device, has a total width of less than 4 mm. The cutting strand is thus preferably designed to produce a cutting gap that has a maximum dimension of less than 4 mm, as viewed along the direction that is at least substantially perpendicular to the cutting plane of the cutting strand.

A "guide unit" is to be understood here to mean, in particular, a unit designed to exert a constraining force upon the cutting strand, at least along a direction perpendicular to a cutting direction of the cutting strand, in order to define a possibility for movement of the cutting strand along the cutting direction. Preferably, the guide unit has at least one guide element, in particular a guide groove, by which the cutting strand is guided. Preferably, the cutting strand, as viewed in the cutting plane of the cutting strand, is guided by the guide unit along an entire circumference of the guide unit by means of the guide element, in particular the guide groove. A "cutting direction" is to be understood here to mean, in particular, a direction along which the cutting strand is moved, in at least one operating state, as a result of a driving force and/or a driving torque, in particular in the guide unit, for the purpose of generating a cutting gap and/or for the purpose of parting-off and/or removing material particles of a workpiece on which work is to be performed. The expression "designed" is intended here to define, in particular, specially configured and/or specially equipped. That an element and/or a unit are/is designed for a particular function is to be understood to mean, in particular, that the element and/or the unit fulfill/fulfills and/or execute/executes this particular function in at least one application state and/or operating state.

The term "closed system" is intended here to define, in particular, a system comprising at least two components that, by means of combined action, when the system is in a state of having been demounted from a system such as, for example, the portable power tool, that is of a higher order than the system, maintain a functionality and/or are inseparably connected to each other when in the demounted state. Preferably, the at least two components of the closed system are connected to each other so as to be at least substantially inseparable by an operator. "At least substantially inseparable" is to be understood here to mean, in particular, a connection of at least two components that can be separated from each other only with the aid of parting tools such as, for example, a saw, in particular a mechanical saw, etc. and/or chemical parting means such as, for example, solvents, etc.

The cutting strand can preferably be tensioned and/or pretensioned by means of the pretensioning unit, in particular when the cutting strand is in a state of having been disposed on the guide unit. The pretensioning unit is preferably designed to effect compensation of a play due to the production process and/or a tolerance due to the production process, in particular when the power-tool parting device is in a state of having been demounted from the coupling device. The pretensioning unit is preferably designed to effect compensation of a play due to the production process and/or a tolerance due to the production process, in particular when the power-tool parting device is in a state of having been demounted from the coupling device. The pretensioning unit is particularly preferably designed to compensate an elongation of the cutting strand, in particular an elongation of the cutting strand caused by performing work on a workpiece. Particularly preferably, the pretensioning unit is designed preferably to automatically compensate the elongation of the cutting strand, in particular an elongation of the cutting strand caused by performing work on a workpiece. The elongation of the cutting strand, in particular an elongation of the cutting strand caused by performing work on a workpiece, can preferably be compensated automatically by means of the pretensioning unit. "An automatic compensation of play and/or tolerance" in this context is to be understood to mean, in particular, a self-acting compensation of elongation, in particular that, in a state of having been disposed on the guide unit, can be effected without intervention by an operator, and/or a self-acting compensation of a play and/or tolerance of the cutting strand that is/are due to a production process, in particular that can be effected without intervention by an operator, by means of action of at least one tensioning force upon the cutting strand, in particular by an element realized separately from the cutting strand. Particularly preferably, the automatic tensioning and/or the automatic pretensioning of the cutting strand can be achieved without intervention by an operator of the portable power tool. The design of the power-tool parting device according to the disclosure makes it possible, advantageously, to prevent the cutting strand from hanging out of the guide unit in an untensioned manner when the guide unit is in a state of having been demounted from the coupling device of the portable power tool. In particular, advantageously, it is possible to prevent damage to the cutting strand in the case of repeated mounting of the guide unit on the portable power tool. Particularly advantageously, repeated mounting of the guide unit on the portable power tool can be achieved and/or facilitated.

Furthermore, it is proposed that the pretensioning unit have at least one resilient pretensioning element that is disposed on at least one movably mounted cutting-strand holding element of the pretensioning unit. In particular, in at least one exemplary embodiment, the pretensioning unit has a single cutting-strand holding element. The cutting-strand holding element is preferably designed to hold the cutting strand. The cutting-strand holding element is movably mounted, in particular in such a manner that the cutting-strand holding element is movable at least in the cutting plane of the cutting strand. Particularly preferably, the cutting-strand holding element is mounted so as to be movable, in the cutting plane of the cutting strand, along a longitudinal extent of the guide unit, in particular along a longitudinal axis of the guide unit. The cutting-strand holding element is disposed at one end of the guide unit, in particular on a drive side of the guide unit. The pretensioning element is preferably designed to apply a force, in particular to automatically apply a force, to the cutting-strand holding element, in particular when the power-tool parting device is in a state of having been demounted from the coupling device of the portable power tool. The pretensioning element may be realized, in particular, as a reversible energy-transforming element. Preferably, the pretensioning element is realized as a resilient element. Particularly preferably, the pretensioning element is realized as a spring element such as, for example, a helical spring, an evolute spring, a disk spring, or the like. The pretensioning element may likewise be realized as another element, considered appropriate by persons skilled in the art, such as, for example, as a gas pressure spring, an oil pressure spring or a piezoactive element. If the pretensioning element is designed as a piezoactive element, it is conceivable that the piezoactive element can be used, in particular, in combination with a sensor for a coupling state of the power-tool parting device. The design of the power-tool parting device according to the disclosure makes it possible, advantageously, to achieve a structurally simple solution for automatic pretensioning of the cutting strand.

Furthermore, it is proposed that the pretensioning unit have at least one resilient pretensioning element that, via one end, is supported on at least one cutting-strand holding element of the pretensioning unit and, via a further end, is supported on at least one coupling element of the guide unit. In particular, the cutting-strand holding element has a support face, on which the resilient pretensioning element is supported via one end. Preferably, the resilient pretensioning element is supported via one end on the support face. The support face is preferably oriented at least substantially perpendicularly in relation to the cutting plane of the cutting strand. Preferably, a normal vector of the support face goes in a direction that is at least substantially parallel to the longitudinal axis of the guide unit. The support face is disposed, facing toward the guide unit, on the cutting-strand holding element. In particular, in at least one exemplary embodiment, the guide unit has a single coupling element. In particular, the coupling element is designed to be connected to the coupling device of the portable power tool in a form-fitting and/or force-fitting manner. Particularly preferably, the coupling element is designed, when the guide unit is in a state of having been disposed on the coupling device of the portable power tool, to secure the power-tool parting device, in particular the guide unit, against twisting and/or tilting relative to the portable power tool, in particular relative to a power tool housing of the portable power tool, as forces and/or torques of the torque transmission element of the portable power tool are being transmitted to the cutting strand. The coupling element, as viewed along the longitudinal axis of the guide unit of the power-tool parting device, is preferably disposed at one end of the power-tool parting device, in particular on the drive side of the guide unit. Preferably, the pretensioning unit comprises at least one mounting opening, which is designed, in particular, to enable the resilient pretensioning element to be disposed in a function position of the resilient pretensioning element, in at least one state in which the pretensioning element is for the most part mounted. The mounting opening enables the pretensioning element to be disposed in an advantageously simple manner when individual subassemblies of the power-tool parting device have already been premounted. Preferably, the mounting opening is disposed, at least, on the coupling element. Preferably, the mounting opening is delimited by an edge region of the coupling element, wherein, in particular, the mounting opening is let into the coupling element. Preferably, the resilient pretensioning element can be disposed in the functional position as a result of the pretensioning element being passed, at least partly, through the mounting opening. In the functional position, the resilient pretensioning element bears, in particular, at least against the cutting-strand holding element and/or the coupling element. Preferably, in the functional position, the resilient pretensioning element is supported, in particular, on the cutting-strand holding element of the pretensioning unit via one end, and on the coupling element of the guide unit via the other end. In the functional position, the resilient pretensioning element preferably exerts, upon the cutting-strand holding element and the coupling element, a force that is designed to move the cutting-strand holding element relative to the coupling element. In particular, the coupling element at least partly surrounds the cutting-strand holding element.

In particular, the coupling element has at least one guide groove, which is designed to guide the cutting-strand holding element, preferably in a plane parallel to the cutting plane of the cutting strand, particularly preferably in a direction parallel to the longitudinal direction of the guide unit. The guide groove preferably has a main course that is at least substantially parallel to the cutting plane of the cutting strand. Preferably, the main course of the guide groove is at least substantially parallel to the longitudinal direction of the guide unit. The guide groove is delimited, in particular, by at least one first delimiting face of the coupling element that is oriented at least substantially parallel to the cutting plane of the cutting strand. Preferably, the guide groove is delimited by at least one further delimiting face of the coupling element that is oriented at least substantially perpendicularly in relation to the cutting plane of the cutting strand. The coupling element is preferably disposed in a fixed manner on the guide unit of the power-tool parting device. The coupling element and the cutting-strand holding element are preferably movable relative to each other, in particular when the power-tool parting device, in particular the guide unit, is in a state of having been demounted from the coupling element of the portable power tool. Preferably the coupling element and the cutting-strand holding element are movable relative to each other parallel to the cutting plane of the cutting strand. Particularly preferably, the coupling element and the cutting-strand holding element are movable relative to each other along the longitudinal axis of the guide unit of the power-tool parting device. The coupling element and the cutting-strand holding element are preferably moved relative to each other by means of a force of the resilient pretensioning element. When the power-tool parting device is in a state of being without the resilient pretensioning element, the coupling element and the cutting-strand holding element are preferably movable relative to each other without a force of the resilient pretensioning element. By means of the design of the power-tool parting device according to the disclosure, it is possible, through simple design means, to achieve a relative automatic movement of the cutting-strand holding element relative to the coupling element.

Furthermore, it is proposed that the pretensioning unit be disposed on the guide unit, at least substantially in mirror symmetry in relation to a cutting plane of the cutting strand. Particularly preferably, the guide unit comprises at least two outer faces that are at least substantially parallel to the cutting plane of the cutting strand. In particular, the pretensioning element is disposed equally on both sides of the guide unit. Preferably, in at least one exemplary embodiment, the single cutting-strand holding element is disposed in mirror symmetry in relation to the cutting plane of the cutting strand. In particular, in at least one exemplary embodiment, the pretensioning unit has two cutting-strand holding elements. Particularly preferably, the two cutting-strand holding elements are disposed on the guide unit, in particular between at least two coupling elements of the guide unit, in mirror symmetry in relation to each other with respect to the cutting plane. Particularly preferably, in at least one exemplary embodiment, the single coupling element is disposed on the guide unit in mirror symmetry in relation to the cutting plane of the cutting strand. In particular, in at least one exemplary embodiment, the guide unit has two coupling elements. Particularly preferably, the two coupling elements are disposed on the guide unit, in mirror symmetry in relation to each other with respect to the cutting plane. Advantageously, it is possible to achieve a uniform force distribution of forces acting upon the guide unit of the power-tool parting device, thereby rendering possible, particularly advantageously, a high degree of stability of the power-tool parting device, in particular while work is being performed on a workpiece.

Furthermore, it is proposed that the pretensioning unit, in particular in at least one exemplary embodiment of the power-tool parting device, comprise at least one cutting-strand holding element, which delimits at least one holding recess of the pretensioning unit that has a maximum width that is less than a maximum cutting-strand thickness of the cutting strand. The cutting-strand holding element has at least one edge region delimiting the holding recess. The maximum width of the holding recess is delimited substantially by the cutting-strand holding element of the pretensioning unit. The maximum width of the holding recess preferably extends perpendicularly in relation to the cutting plane of the cutting strand. The maximum width of the holding recess is disposed on the guide unit, at least substantially in mirror symmetry in relation to the cutting plane of the cutting strand. The maximum width of the holding recess is, in particular, less than 4 mm, preferably less than 3 mm, and particularly preferably less than 1 mm. The holding recess is preferably designed to hold the cutting strand, in particular while the power-tool parting device is in a state of having been demounted from the coupling device of the portable power tool. Preferably, cutter carrier elements of the cutting strand are disposed, at least partly, in the holding recess, in particular while the power-tool parting device is in a state of having been demounted from the coupling device of the portable power tool. Preferably, crossed cutting elements of the cutter carrier elements of the cutting strand bear against an edge region of the cutting-strand holding element that delimits the holding recess, in particular while the power-tool parting device is in a state of having been demounted from the coupling device of the portable power tool. The design of the power-tool parting device according to the disclosure advantageously enables the cutting strand to be held on the cutting-strand holding element. Moreover, particularly advantageously, it is possible to avoid the situation in which the cutting strand hangs out from the guide unit in an untensioned manner. Particularly advantageously, the torque transmission element of the coupling device of the portable power tool can be inserted in a particularly efficient and simple manner.

Furthermore, it is proposed that the pretensioning unit, in particular in at least one exemplary embodiment of the power-tool parting device, comprise at least two cutting-strand holding elements, which together delimit a holding recess of the pretensioning unit, wherein at least one distance element of the pretensioning unit is disposed on at least one of the cutting-strand holding elements in order to ensure a feed-through distance. The feed-through distance is realized, in particular, as a width, preferably as the maximum width of the holding recess. The feed-through distance extends at least substantially perpendicularly in relation to the cutting plane of the cutting strand. The feed-through distance is designed, in particular, to enable an element, a component and/or a device to be fed through the cutting-strand holding element. Preferably, the feed-through distance is designed to enable the cutting strand of the power-tool parting device to be fed through the cutting-strand holding element in a secure manner. The distance element of the pretensioning unit extends along a direction of main extent of the distance element, at least substantially perpendicularly in relation to the cutting plane of the cutting strand. The distance element is disposed, at least substantially, in a circular-ring segment region of the cutting-strand holding elements, on one of the at least two cutting-strand holding elements. The circular-ring segment region is disposed, on a side facing away from the pretensioning element, on one of the at least two cutting-strand holding elements. The circular-ring segment region extends along an angular range of less than 180°, preferably less than 120°, and particularly preferably less than 60°. In particular, in at least one exemplary embodiment, the pretensioning unit has a single distance element. In particular, in at least one exemplary embodiment, the pretensioning unit has a single distance element that, in at least one exemplary embodiment, is realized such that it is separate from a single cutting-strand holding element. The distance element of the pretensioning unit is preferably disposed on the guide unit in mirror symmetry in relation to the cutting plane of the cutting strand. Preferably, in at least one exemplary embodiment, the pretensioning unit has two distance elements that are respectively disposed on one of the at least two cutting-strand holding elements. Preferably, in at least one exemplary embodiment, the pretensioning unit has two distance elements that are respectively realized such that they are integral with one of the at least two cutting-strand holding elements. The distance elements of the pretensioning unit are disposed on the guide unit in mirror symmetry in relation to each other with respect to the cutting plane. Advantageously, a minimum feed-through distance can be ensured, thereby ensuring that the cutting strand is held securely.

Furthermore, it is proposed that the pretensioning unit have at least one force-fit and/or form-fit element that is designed to secure at least one cutting-strand holding element of the pretensioning unit against movement in a cutting plane of the cutting strand. Particularly preferably, the pretensioning unit has at least one force-fit and/or form-fit element that is designed to secure at least two cutting-strand holding elements of the pretensioning unit against a movement in a cutting plane of the cutting strand, in particular relative to each other. Preferably, each of the at least two cutting-strand holding elements has, respectively, at least one force-fit and/or form-fit element. The respective force-fit and/or form-fit element of one of the at least two cutting-strand holding elements is realized so as to correspond to the at least one respective force-fit and/or form-fit element of the other of the at least two cutting-strand holding elements. The force-fit and/or form-fit element may be realized as a protuberance or a depression. Preferably, the force-fit and/or form-fit element of one of the cutting-strand holding elements fixes the at least two cutting-strand holding elements of the pretensioning unit to each other in a form-fitting and/or force-fitting manner, at least in a cutting plane of the cutting strand, in particular against a movement in a cutting plane, by means of action in combination with the force-closure and/or form-closure element of the other cutting-strand holding element. For the purpose of fixing the at least two cutting-strand holding elements in a form-fitting and/or force-fitting manner, the force-closure and/or form-closure element, at least on the one cutting-strand holding element, preferably engages in the correspondingly realized force-closure and/or form-closure element of the other cutting-strand holding element. The design according to the disclosure advantageously enables the at least one cutting-strand holding element to be held in a position relative to at least one other element. Moreover, advantageously, when the power-tool parting device is in a state of having been demounted from the coupling device of the portable power tool, a movement of the at least two cutting-strand holding elements can be synchronized in the case of a movement along the longitudinal axis of the guide unit.

Also proposed is a power tool system, having at least one power-tool parting device according to the disclosure, and having at least one portable power tool, which has at least one coupling device for coupling to the power-tool parting device according to the disclosure in a form-fitting and/or force-fitting manner. A "portable power tool" is to be understood here to mean, in particular, a power tool, in particular a hand power tool, that can be transported by an operator without the use of a transport machine. The portable power tool has, in particular, a mass of less than 40 kg, preferably less than 10 kg, and particularly preferably less than 5 kg. Advantageously, it is possible to realize a power tool system in which, following use of the cutting strand for the purpose of performing work on the workpiece, an elongation of the cutting strand can be compensated, preferably compensated automatically, in particular when the guide unit is in a state of having been demounted from the coupling device of the portable power tool. In addition, advantageously, it is possible to realize a power tool system in which compensation of a play due to the production process and/or a tolerance due to the production process can be effected, preferably effected automatically, before the cutting strand is used to perform work on the workpiece, in particular when the guide unit is in a state of having been demounted from the coupling device of the portable power tool. In particular, particularly advantageously, owing to the design of the power tool system according to the invention disclosure, the cutting strand remains tensioned. In particular, advantageously, damage to the cutting strand can be prevented in the case of repeated mounting of the guide unit on the portable power tool. Advantageously, repeated mounting of the guide unit on the power tool can be achieved and/or facilitated.

Particularly preferably, the power tool system is realized in such a manner that the pretensioning unit has at least one cutting-strand holding element that has at least one insertion functional face, which is designed to effect at least one force component contrary to a pretensioning force of the pretensioning element, at least while the power-tool parting device is being disposed on the coupling device. The insertion functional face is disposed, substantially perpendicularly in relation to the cutting plane of the cutting strand, on at least one cutting-strand holding element. In particular, while the power-tool parting device is being disposed on the coupling device of the portable power tool, a face of the coupling device of the portable power tool that is realized so as to correspond to the insertion functional face acts on the insertion functional face. A "force component" is to be understood here, in particular, to mean a component that is part of a force vector. In particular, the force component is oriented parallel to the cutting plane of the cutting strand, preferably parallel to the longitudinal axis of the guide unit. Particularly preferably, the force component is oriented contrary to the pretensioning force that, in particular, moves the cutting-strand holding element, in the cutting plane of the cutting strand, along the longitudinal axis of the guide unit. The design of the power tool system according to the disclosure makes it possible, advantageously, to achieve automatic release of the cutting-strand holding element in the case of mounting of the power-tool parting device on the coupling device of the portable power tool.

The power-tool parting device according to the disclosure and/or the power tool system according to the disclosure are/is not intended in this case to be limited to the application and embodiment described above. In particular, the power-tool parting device according to the disclosure and/or the power tool according to the disclosure may have individual elements, component parts and units, and procedure steps, that differ in number from a number stated herein, in order to fulfill an operating principle described herein. Moreover, in the case of the value ranges specified in this disclosure, values lying within the stated limits are also to be deemed as disclosed and applicable in any manner.

BRIEF DESCRIPTION OF THE DRAWINGS

Further advantages are disclosed by the following description of the drawings. An exemplary embodiment of the disclosure is represented in the drawings. The drawings, the description and the claims contain numerous features in combination. Persons skilled in the art will also expediently consider the features individually and combine them to create appropriate further combinations.

There are shown in.

DETAILED DESCRIPTION

Figure 1:
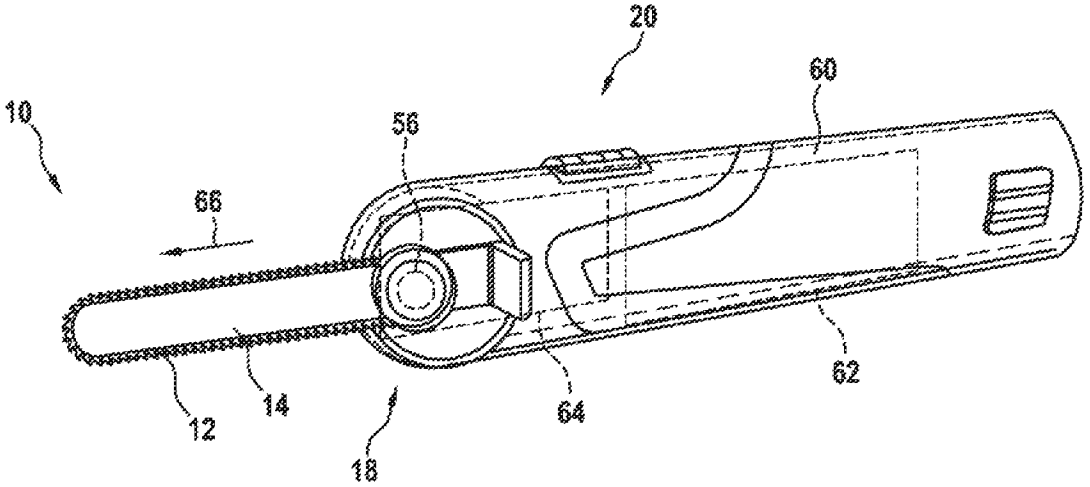
FIG. 1 a portable power tool according to the disclosure, having a power-tool parting device according to the disclosure, in a schematic representation, FIG. 2 a detail view of the power-tool parting device according to the disclosure, in a schematic representation, FIG. 3 a sectional view of the power-tool parting device according to the disclosure along the longitudinal axis of the power-tool parting device according to the disclosure from FIG. 2, in a schematic representation, and FIG. 4 a detail view of two cutting-strand holding elements of the power-tool parting device according to the disclosure, in a schematic representation.

FIG. 1 shows a portable power tool 20, having a power-tool parting device 10, which together constitute a power-tool system. The portable power tool 20 has at least one coupling device 18 for coupling in a form-fitting and/or force-fitting manner to the power-tool parting device 10. The coupling device 18 in this case may be realized as a bayonet fixing, snap fixing and/or as another coupling device, considered appropriate by persons skilled in the art. The portable power tool 20 has at least one torque transmission element 56. The torque transmission element 56 in this case may be realized as a toothed wheel, in particular as a pinion. The power-tool parting device 10 comprises at least one cutting strand 12, and at least one guide unit 14 for guiding the cutting strand 12. The guide unit 14, together with the cutting strand 12, constitutes a closed system. The torque transmission element 56 engages directly in the cutting strand 12 for the purpose of driving the cutting strand 12.

The portable power tool 20 additionally has a power tool housing 60, which encompasses a drive unit 62 and a transmission unit 64 of the portable power tool 20. The drive unit 62 and the transmission unit 64 are connected to each other, in a manner already known to persons skilled in the art, for the purpose of generating a driving torque that can be transmitted to the power-tool parting device 10. The transmission unit 64 is preferably realized as a bevel gear transmission. The drive unit 62 is preferably realized as an electric motor unit. It is also conceivable, however, for the drive unit 62 and/or the transmission unit 64 to be of a different design, considered appropriate by persons skilled in the art, such as, for example, the transmission unit 64 designed as a worm gear transmission, etc. The drive unit 62 is designed to drive the cutting strand 12 of the power-tool parting device 10, in at least one operating state, via the transmission unit 64. In the guide unit 14 of the power-tool parting device 10, the cutting strand 12 is moved in the guide unit 14, along a cutting direction 66 of the cutting strand 12, in particular relative to the guide unit 14.

Figure 2:
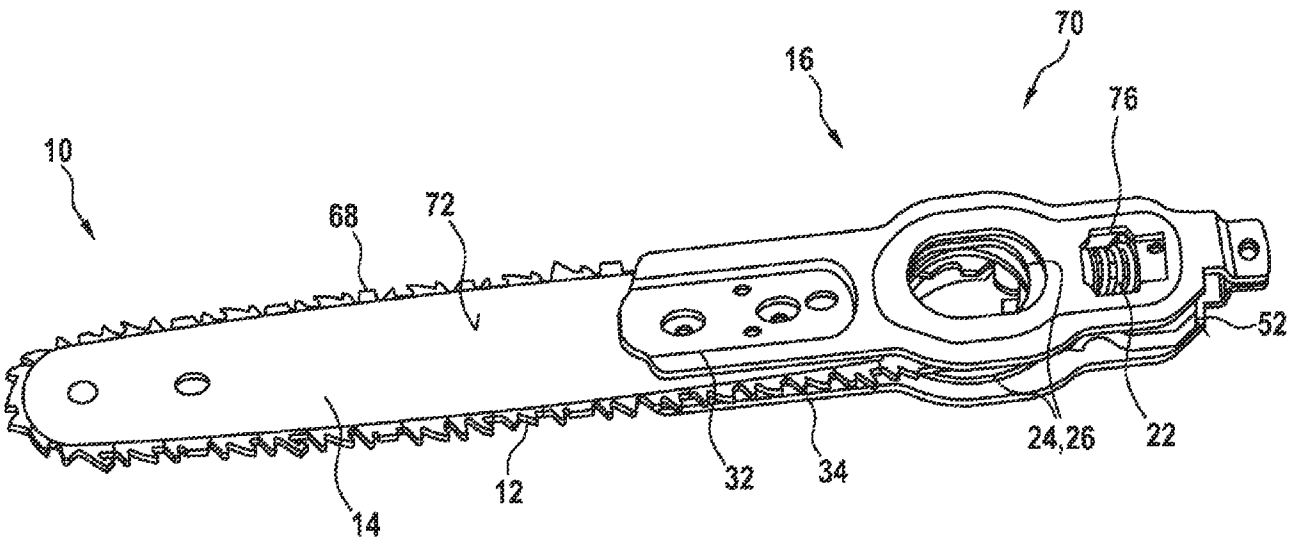

FIG. 2 shows the power-tool parting device 10 in a state of having been demounted from the coupling device 18 of the portable power tool 20. The power-tool parting device 10 is realized without a torque transmission element 56. The power-tool parting device 10 has the cutting strand 12 and the guide unit 14, which together constitute a closed system. The cutting strand 12 is guided by means of the guide unit 14. The guide unit 14 has at least one guide element realized as a guide groove (not represented in greater detail here), by means of which the cutting strand 12 is guided. The cutting strand 12 is guided by means of edge regions of the guide unit 14 that delimit the guide groove. It is also conceivable, however, for the guide element to be realized in a different manner, considered appropriate by persons skilled in the art, such as, for example, as a rib type formation on the guide unit 14 that engages in a recess on the cutting strand 12. The cutting strand 12 additionally comprises a multiplicity of cutter carrier elements 68, which are connected to each other and form the cutting strand 12 realized as a cutting chain.

Figure 3:
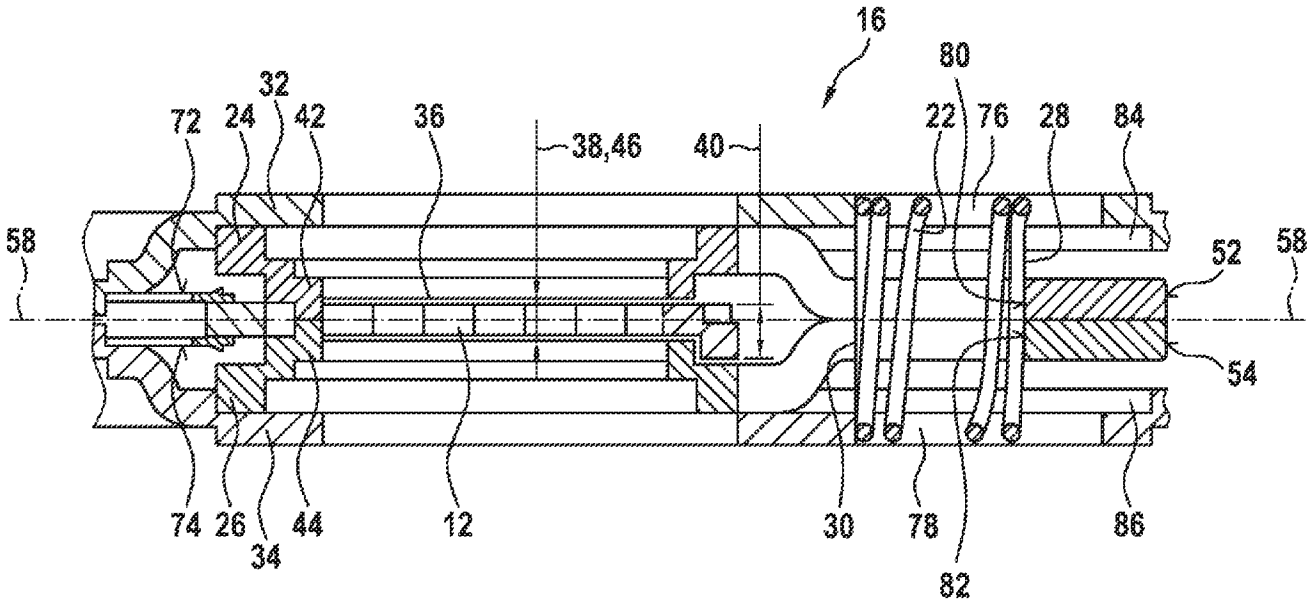

The power-tool parting device 10 additionally comprises at least one pretensioning unit 16, which is provided on the guide unit 14 and is designed to automatically compensate play and/or tolerance of the cutting strand 12, at least while the guide unit 14 is in a state of having been demounted from the coupling device 18 of the portable power tool 20. The pretensioning unit 16 is disposed, at least partly, on a drive side 70 of the guide unit 14. The pretensioning unit 16 is disposed on the guide unit 14, at least substantially in mirror symmetry in relation to the cutting plane 58 of the cutting strand 12. The guide unit 14 comprises at least one coupling element 32 disposed on the guide unit 14. The coupling element 32 is disposed on an outer face 72 of the guide unit 14. The guide unit 14 additionally comprises at least one further coupling element 34, disposed on the guide unit 14 (FIG. 3). The further coupling element 34 is disposed on a further outer face 74 of the guide unit 14, which is at least substantially parallel to the outer face 72. The coupling element 32 and the further coupling element 34 are disposed on the guide unit 14, substantially in mirror symmetry in relation to each other with respect to the cutting plane 58 of the cutting strand 12 (FIG. 3). It is likewise conceivable that, in an exemplary embodiment of the power-tool parting device 10 that is not represented in greater detail here, the guide unit 14, as an alternative to having the coupling element 32 and the further coupling element 34, has a single coupling element that is preferably disposed on the guide unit 14 in mirror symmetry in relation to the cutting plane 58 of the cutting strand 12 and that, in particular, has all features of the coupling element 32 and of the further coupling element 34. Particularly preferably, by means of the coupling element 32 and the further coupling element 34, the guide unit 14, in particular the power-tool parting device 10, is secured against twisting resulting from transmission of torques by the torque transmission element 56 of the portable power tool 20 while in a state of having been disposed on the coupling device 18 of the portable power tool 20.

The pretensioning unit 16 additionally comprises at least one cutting-strand holding element 24 disposed on the guide unit 14. The cutting-strand holding element 24 is surrounded, at least partly, by the coupling element 32. The pretensioning unit 16 additionally comprises at least one further cutting-strand holding element 26, disposed on the guide unit 14 (FIG. 3). The further cutting-strand holding element 26 is surrounded, at least partly, by the further coupling element 34. Furthermore, the pretensioning unit 16 comprises at least one mounting opening 76, which is designed for easy mounting of a resilient pretensioning element 22 of the pretensioning unit 16 on the pretensioning unit 16. The pretensioning unit 16 additionally comprises at least one further mounting opening 78, which is designed for easy mounting of the resilient pretensioning element 22 on the pretensioning unit 16. Preferably, the mounting opening 76 is disposed on the coupling element 32. Preferably, the further mounting opening 78 is disposed on the further coupling element 34. The mounting opening 76 is delimited by at least one edge region of the coupling element 32. The further mounting opening 78 is delimited by at least one edge region of the further coupling element 34. The resilient pretensioning element 22 can be disposed on the coupling element 32 and on the further coupling element 34 through at least one of the mounting openings 76, 78. The resilient pretensioning element 22 can be disposed in a functional position on the pretensioning unit 16 by being inserted through at least one of the mounting openings 76, 78. In the functional position, the pretensioning element 22 bears at least partly against the edge region of the coupling element 32 that delimits the mounting opening 76, and against the edge region of the further coupling element 34 that delimits the further mounting opening 78. In the functional position, the pretensioning element 22 bears at least partly against the cutting-strand holding element 24 and against the further cutting-strand holding element 26. The cutting-strand holding element 24 and the further cutting-strand holding element 26 are disposed on the guide unit 14, substantially in mirror symmetry in relation to each other with respect to the cutting plane 58 of the cutting strand 12. It is likewise conceivable, in an exemplary embodiment of the power-tool parting device 10 that is not represented in greater detail here, for the pretensioning unit 16, as an alternative to having the cutting-strand holding element 24 and the further cutting-strand holding element 26, to have a single cutting-strand holding element that, preferably, is disposed on the guide unit 14 in mirror symmetry in relation to the cutting plane 58 of the cutting strand 12 and that, in particular, has all features of the cutting-strand holding element 24 and of the further cutting-strand holding element 26. The cutting-strand holding element 24 and the further cutting-strand holding element 26 are disposed in a movably mounted manner on the guide unit 14. The cutting-strand holding element 24 and the further cutting-strand holding element 26 are mounted so as to be translationally movable relative to the guide unit 14. The cutting-strand holding element 24 and the further cutting-strand holding element 26 are mounted so as to be translationally movable relative to the coupling element 32 and the further coupling element 34. The coupling element 32 has at least one guide groove 84, which is designed to guide the cutting-strand holding element 24 in a direction parallel to the longitudinal direction of the guide unit 14. The further coupling element 34 has at least one further guide groove 86, which is designed to guide the further cutting-strand holding element 26 in a direction parallel to the longitudinal direction of the guide unit 14. It is likewise conceivable for the coupling element 32 and/or the further coupling element 34, as an alternative to having the guide groove 84, 86, to have a guide extension, which is designed to guide the cutting-strand holding element 24 and/or the further cutting-strand holding element 26, in particular as a result of action in combination with a guide groove disposed on the cutting-strand holding element 24 and/or on the further cutting-strand holding element 26. It is additionally conceivable that, in an exemplary embodiment of the power-tool parting device 10 that is not represented in greater detail here, the pretensioning unit 16, as an alternative to having the cutting-strand holding element 24 and the further cutting-strand holding element 26, has a single cutting-strand holding element, which can be guided in the guide groove 84 and/or the further guide groove 86.

Figure 4:
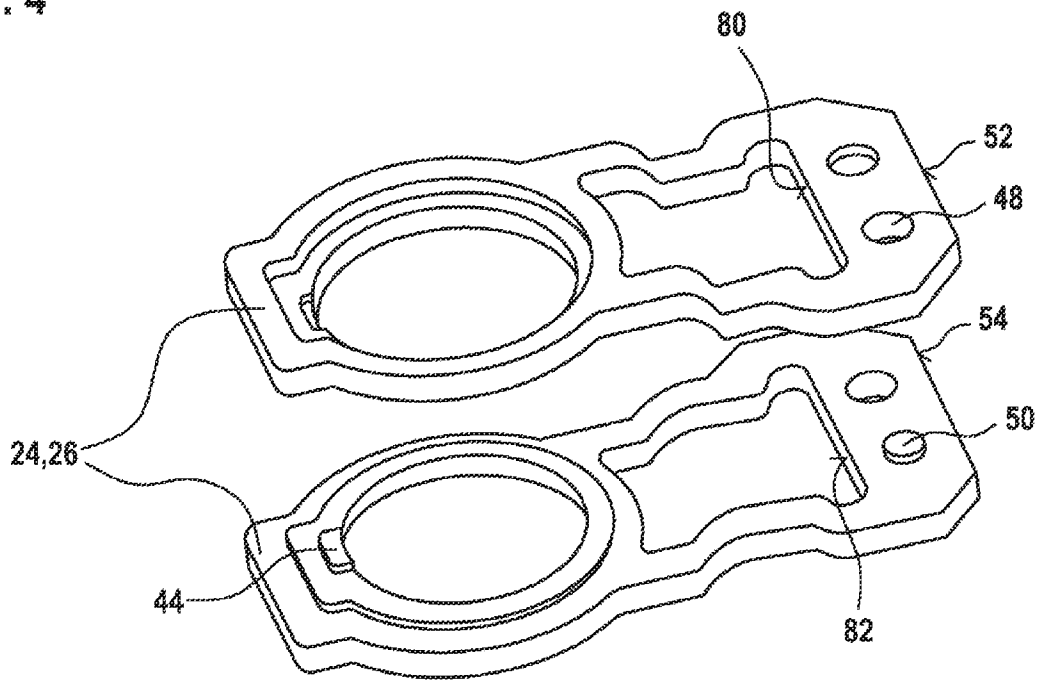

Furthermore, the pretensioning unit 16 has at least one resilient pretensioning element 22, which is disposed on at least one of the movably mounted cutting-strand holding elements 24, 26 of the pretensioning unit 16 (FIG. 3). In the exemplary embodiment shown in FIGS. 2 to 4, the at least one resilient pretensioning element 22 of the pretensioning unit 16 is disposed on both movably mounted cutting-strand holding elements 24, 26 of the pretensioning unit 16. It is likewise conceivable that, in an exemplary embodiment of the power-tool parting device 10 that is not represented in greater detail here, the at least one resilient pretensioning element 22 of the pretensioning unit 16 is disposed on a single movably mounted cutting-strand holding element of the pretensioning unit 16. The two movably mounted cutting-strand holding elements 24, 26 hold the cutting strand 12 in a tensioned state when the guide unit 14 is in a state of having been demounted from the coupling device 18 of the portable power tool 20.

The cutting-strand holding elements 24, 26 delimit a holding recess 36 of the pretensioning unit 16 by means of an edge region. For the purpose of holding the cutting strand 12, crossed cutting elements of the cutting strand 12 bear against the edge region (FIG. 3). The cutting elements are disposed on the cutter carrier elements 68 of the cutting strand 12 and, in particular, are realized so as to be integral with the cutter carrier elements 68. The cutter carrier elements 68 engage in the holding recess 36 of the pretensioning unit 16 for the purpose of holding the cutting strand 12. In this exemplary embodiment (FIGS. 2 to 4), the resilient pretensioning element 22 is realized as a helical spring. It is also conceivable, however, for the resilient pretensioning element 22 to be realized as another element, considered appropriate by persons skilled in the art, such as, for example, a leg spring, a disk spring, an air spring, a piston, a piezoactive element, etc.

The at least two cutting-strand holding elements 24, 26 together delimit the holding recess 36 of the pretensioning unit 16, at least one distance element 42, 44 of the pretensioning unit 16 being disposed on at least one of the cutting-strand holding elements 24, 26 in order to ensure a feed-through distance 46. The feed-through distance 46 corresponds to a maximum width 38 of the holding recess 36. The feed-through distance 46 extends at least substantially perpendicularly in relation to the cutting plane 58 of the cutting strand 12. The feed-through distance 46 is disposed in mirror symmetry with respect to the cutting plane 58 of the cutting strand 12. In the exemplary embodiment of the power-tool parting device 10 shown here, at least one distance element 42 and a further distance element 44, for ensuring the feed-through distance 46, are respectively disposed on at least one of the cutting-strand holding elements 24, 26. The distance element 42 and the further distance element 44 are disposed, in mirror symmetry in relation to each other with respect to the cutting plane 58 of the cutting strand 12, on one of the at least two cutting-strand holding elements 24, 26. One of the distance elements 42, 44 is disposed on respectively one of the cutting-strand holding elements 24, 26. The distance element 42 and the further distance element 44 are disposed in a circular-ring segment region of the at least two cutting-strand holding elements 24, 26, on the respective cutting-strand holding element of the at least two cutting-strand holding elements 24, 26. It is likewise conceivable that, in an exemplary embodiment of the power-tool parting device 10 that is not represented in greater detail here, the pretensioning unit 16, as an alternative to having the distance element 42 and the further distance element 44, has a single distance element that is disposed on at least one of the cutting-strand holding elements 24, 26 for the purpose of ensuring a feed-through distance 46 and, in particular, has all features of the distance element 42 and of the further distance element 44.

In addition, at least one of the cutting-strand holding elements 24, 26 delimits at least the holding recess 36 of the pretensioning unit 16, which has the maximum width 38 that is less than a maximum cutting strand thickness 40 of the cutting strand 12. The maximum width 38 extends at least substantially perpendicularly in relation to the cutting plane 58 of the cutting strand 12. The maximum cutting strand thickness 40 of the cutting strand 12 corresponds, at least substantially, to a maximum width of the cutter carrier elements 68. Owing to the crossing of the cutting elements, the cutting elements bear against the edge region of at least one of the cutting-strand holding elements 24, 26 that delimits the holding recess 36, in particular side of the edge regions of the cutting-strand holding elements 24, 26 that faces toward the resilient pretensioning element 22 of the pretensioning unit 16.

The pretensioning unit 16 additionally has at least the resilient pretensioning element 22, which is supported via one end 28 on at least one of the cutting-strand holding elements 24, 26 of the pretensioning unit 16, and is supported via another end 30 on at least one of the coupling elements 32, 34 of the guide unit 14 (FIGS. 2 and 3). The cutting-strand holding element 24 has a support face 80, on which the resilient pretensioning element 22 is supported via the end 28. The further cutting-strand holding element 26 has a further support face 82, on which the resilient pretensioning element 22 is supported via the end 28. The resilient pretensioning element 22 bears, via the end 28, against the support faces 80, 82. The support face 80 is disposed on the cutting-strand holding element 24, on a side of an end piece of the cutting-strand holding element 24 that faces toward the guide unit 14. The further support face 82 is preferably disposed on the further cutting-strand holding element 26, on a side of an end piece of the further cutting-strand holding element 26 that faces toward the guide unit 14. The resilient pretensioning element 22 is realized as a spring element, in particular as a helical spring. The pretensioning element 22 bears against the support faces 80, 82 via a coil of the spring element. It is likewise conceivable that, in an exemplary embodiment that is not represented in greater detail here, in which the power-tool parting device 10 has a single cutting-strand holding element, which preferably has a single support face, on which the resilient pretensioning element 22 is supported via one end. While the guide unit 14 is in a state of having been demounted from the coupling device 18 of the portable power tool 20, the translationally movable cutting-strand holding elements 24, 26 can be moved automatically, relative to the coupling elements 32, 34 and the guide unit 14, by a force of the resilient pretensioning element 22, such that the cutting strand 12 is automatically in a tensioned state, and thus automatically effects compensation of play and/or tolerance of the cutting strand 12. Crossed cutting elements of the cutter carrier elements 68 of the cutting strand 12 in this case bear against the edge regions of the cutting-strand holding elements 24, 26 that delimit the holding recess 36, in particular to enable the cutting strand 12 to be held in a mounting position. The cutting strand 12 is brought into a tensioned state as a result of a movement of the cutting-strand holding elements 24, 26 relative to the guide unit 14 and the coupling element 32, and to the further coupling element 34.

The pretensioning unit 16 additionally has at least one force-fit and/or form fit element 48, 50 that is designed to secure at least one of the cutting-strand holding elements 24, 26 of the pretensioning unit 16 against a movement in a cutting plane 58 of the cutting strand 12. Furthermore, the pretensioning unit 16 has at least one force-fit and/or form-fit element 48, 50 that fixes at least two cutting-strand holding elements 24, 26 of the pretensioning unit 16 to each other in a form-fitting and/or force-fitting manner, at least in a cutting plane 58 of the cutting strand 12. Preferably, each of the at least two cutting-strand holding elements 24, 26 has, respectively, at least one force-fit and/or form-fit element 48, 50. The force-fit and/or form-fit element 48 of the cutting-strand holding element 24 is realized such that it corresponds to the force-fit and/or form-fit element 50 of the cutting-strand holding element 26. The force-fit and/or form-fit element 48 of the cutting-strand holding element 24 is preferably realized as a protuberance. The force-fit and/or form-fit element 50 of the cutting-strand holding element 26 is preferably realized as a depression. For the purpose of fixing the at least two cutting-strand holding elements 24, 26 to each other, the force-fit and/or form-fit element 48 of the cutting-strand holding element 24 acts in combination with the correspondingly realized force-fit and/or form-fit element 50 of the cutting-strand holding element 26.

Furthermore, at least one of the cutting-strand holding elements 24, 26 has at least one insertion functional face 52, 54, which is designed to effect at least one force component contrary to a pretensioning force of the pretensioning element 22, at least while the power-tool parting device 10 is being disposed on the coupling device 18. In the exemplary embodiment shown here, both cutting-strand holding elements 24, 26 respectively have at least one insertion functional face 52, 54, which is designed to effect at least one force component contrary to a pretensioning force of the pretensioning element 22, at least while the power-tool parting device 10 is being disposed on the coupling device 18. The insertion functional faces 52, 54 are disposed, at least substantially perpendicular to the cutting plane 58 of the cutting strand 12, on the respective cutting-strand holding elements 24, 26. The insertion functional faces 52, 54 are disposed on the cutting-strand holding elements 24, 26, at an end of the cutting-strand holding elements 24, 26 that faces away from the resilient pretensioning element 22. When the power-tool parting device 10 is being disposed on the coupling device 18 of the portable power tool 20, at least one face of the coupling device 18 of the portable power tool 20, that is realized so as to correspond to the insertion functional faces 52, 54, acts in combination with the insertion functional faces 52, 54. As a result of combined action of the insertion functional faces 52, 54 and the face of the coupling device 18, a force that is directed contrary to a force generated by the pretensioning element 22 can be exerted upon the cutting-strand holding elements 24, 26. The cutting-strand holding elements 24, 26 are moved relative to the guide unit 14. The cutting-strand holding elements 24, 26 can be moved, starting from the drive side 70 of the guide unit 14, in the direction of a side of the guide unit 14 that faces away from the drive side 70, in particular along a direction that is at least substantially parallel to the longitudinal axis of the guide unit 14. The crossed cutting elements are at least substantially without contact to the cutting-strand holding elements 24, 26, in particular to the edge regions of the cutting-strand holding elements 24, 26 that delimit the holding recess 36. A tensioned state of the cutting strand 12, for performing work on a workpiece, is achieved by a tensioning device of the portable power tool 20.

The invention claimed is:

1. A power tool system, comprising:

at least one power-tool parting device configured without a torque transmission element, the power-tool parting device including:

at least one cutting strand, at least one guide unit onto which the cutting strand is guided, the guide unit together with the cutting strand constitutes a closed system, and at least one pretensioning unit disposed on the guide unit, the pretensioning unit configured to automatically compensate for one or more of play and tolerance of the cutting strand at least when the guide unit is in a state in which the guide unit is demounted from a coupling device of a portable power tool; and at least one portable power tool that includes at least one coupling device configured to couple to the power-tool parting device in one or more of a form-fitting manner and a force-fitting manner, wherein the pretensioning unit has at least one cutting-strand holding element that has at least one insertion functional face configured to effect at least one force component contrary to a pretensioning force of a pretensioning element of the pretensioning unit at least while the power-tool parting device is disposed on the coupling device.

2. A power-tool parting device configured without a torque transmission element, comprising:

at least one cutting strand;

at least one guide unit onto which the cutting strand is guided, the guide unit together with the cutting strand constitutes a closed system; and at least one pretensioning unit disposed on the guide unit, the pretensioning unit configured to automatically compensate for one or more of play and tolerance of the cutting strand at least when the guide unit is in a state in which the guide unit is demounted from a coupling device of a portable power tool, wherein the pretensioning unit has at least one resilient pretensioning element having a first end and a second end, the pretensioning element is supported at the first end on at least one cutting-strand holding element of the pretensioning unit and is supported at the second end on at least one coupling element of the guide unit.

3. The power-tool parting device as claimed in claim 2, wherein the at least one cutting-strand holding element is movably mounted.

4. The power-tool parting device as claimed in claim 2, wherein the pretensioning unit is disposed on the guide unit at least substantially in mirror symmetry in relation to a cutting plane of the cutting strand.

5. The power-tool parting device as claimed in claim 2, wherein the at least one cutting-strand holding element delimits at least one holding recess of the pretensioning unit that has a maximum width that is less than a maximum cutting-strand thickness of the cutting strand.

6. The power-tool parting device as claimed in claim 2, wherein the pretensioning unit has one or more of at least one force-fit element and at least one form-fit element that is configured to secure the at least one cutting-strand holding element of the pretensioning unit against movement in a cutting plane of the cutting strand.

7. A power-tool parting device configured without a torque transmission element, comprising:

at least one cutting strand;

at least one guide unit onto which the cutting strand is guided, the guide unit together with the cutting strand constitutes a closed system; and at least one pretensioning unit disposed on the guide unit, the pretensioning unit configured to automatically compensate for one or more of play and tolerance of the cutting strand at least when the guide unit is in a state in which the guide unit is demounted from a coupling device of a portable power tool, wherein the pretensioning unit comprises at least two cutting-strand holding elements, which together delimit a holding recess of the pretensioning unit, and wherein at least one distance element of the pretensioning unit is disposed on at least one of the cutting-strand holding elements in order to ensure a feed-through distance.

8. The power-tool parting device as claimed in claim 7, wherein the pretensioning unit has one or more of at least one force-fit element and at least one form-fit element that fixes the at least two cutting-strand holding elements of the pretensioning unit to each other in one or more of a form-fitting manner and a force-fitting manner, at least in a cutting plane of the cutting strand.

* * * * *